United States Patent [19]

Di Maio et al.

[11] 4,088,004

[45] May 9, 1978

[54] FASTENING TOOL DEVICE

[75] Inventors: Anthony E. Di Maio; Joseph G. Todisco, both of Georgetown, Mass.

[73] Assignee: Marson Fastener Corporation, Chelsea, Mass.

[21] Appl. No.: 796,806

[22] Filed: May 13, 1977

[51] Int. Cl.[2] ..... B21J 15/34

[52] U.S. Cl. ..... 72/391

[58] Field of Search ..... 72/391, 409

[56] References Cited

U.S. PATENT DOCUMENTS

| | | | |
|---|---|---|---|
| 3,154,210 | 10/1964 | Elliott | 72/391 |
| 3,302,444 | 2/1967 | Elliott | 72/391 |
| 3,326,030 | 6/1967 | Di Maio | 72/391 |
| 3,359,778 | 12/1967 | Di Maio | 72/391 |
| 3,596,496 | 8/1971 | La Pointe | 72/391 |
| 3,955,395 | 5/1976 | Vecchione | 72/391 |
| 4,027,556 | 6/1977 | Klein | 72/391 |

*Primary Examiner*—C.W. Lanham

*Assistant Examiner*—Gene P. Crosby

[57] ABSTRACT

Apparatus is disclosed for gripping and pulling on an elongated mandrel of a blind rivet, and having a first handle with a supporting surface and an opening therethrough for receiving the mandrel. A second handle having a mandrel receiving portion is mounted on the tool about a pivotal axis. A jaw is mounted for movement relative to the second handle about the pivotal axis. A mandrel is insertable through the opening between the receiving portion and the jaw. A spring initially biases the jaw means into contact with the supporting surface while the second handle moves towards the closed position such that the receiving portion moves towards the jaw to cause the mandrel to become tightly gripped between it and the jaw whereupon the continued movement of the second handle to the closed position moves the jaw away from contact with the supporting surface and into tighter gripping engagement with the mandrel to forcefully pull generally upwardly on the mandrel.

10 Claims, 5 Drawing Figures

FASTENING TOOL DEVICE

BACKGROUND OF THE INVENTION

1. Field of the Invention

In general, this particular invention pertains to an apparatus for setting rivets. More specifically, it relates to a novel and improved blind rivet setting tool for setting blind rivet fasteners in material, which tool is extremely simple in construction and highly efficient and reliable in operation.

2. Description of the Prior Art

Blind rivet fasteners for rivetting together various sheets of material have become widely accepted in industry for a variety of reasons. In general, these rivet fasteners are of the type which include a rivet body and a generally elongated rivet mandrel having a head portion. In a typical setting operation therefor, it will be understood that they are inserted into the components to be joined and the mandrel is gripped by a mechanism which is actuated to pull the mandrel axially away from the body. In customary fashion, the axially pulled head upsets the rivet body forming a blind head and the mandrel is eventually ruptured from the upset rivet body. Consequently, a rivet is fastened or set in the material or components to be joined.

Several mechanisms exist which satisfactorily serve the purpose of setting the foregoing types of blind rivets. One conventional category includes hand-held tools. These tools are generally characterized as including two levers or tong arms that are adapted to be pivotally moved towards and away from each other wherein at least one of the arms has associated therewith a conventional chuck assembly arranged to slidably receive and grasp the mandrel in response to movement of the arms. Typically, in response to squeezing the lever or tong arms together, the chuck assembly grips the mandrel and thereafter in further response to movement of the arms together pulls upon the rivet mandrel to set the rivet and rupture the mandrel. The noted hand tool, which is a standard type, performs satisfactorily and has found wide acceptance in the field. Other kinds of rivet setting tools are operated by pneumatic piston-cylinder devices to pivot a lever arm or the like which serves to linearly displace a rod of the standard chuck mechanism to thereby set the rivet. It should be appreciated, however, that whether the above noted type of the blind rivet setting mechanisms are manually operated or pneumatically powered they include the noted jaw chuck mechanism.

The standard chuck mechanism, however, usually includes a threaded nose piece, a collet member, a plurality of gripping jaw members slidably movable within the collet, a spring member for biasing the jaws, and an actuating rod. As is apparent, the conventional rivet setting tools which employ a chuck mechanism having these components are relatively more complicated in construction and costly to produce and assemble than a tool without such components.

There are other known blind rivet setting mechanisms which do not, however, include the above noted type of jaw chuck mechanism. Such types may be generally characterized as including a pair of squeezable tong arms, a manual jaw gripping member which moves relatively to a front section rivet mandrel holder so as to grip a rivet mandrel therebetween. As the tong arms are moved relatively to each other, the jaw member grips the mandrel between it and the mandrel holder and eventually sets the rivet and ruptures the mandrel. Although such devices do not require the use of the noted collet mechanism, they are nevertheless considered relatively complicated in construction and costly to manufacture. These types may be of the category generally described in U.S. Pat. Nos. 3,154,210 and 3,596,496. One significant reason contributing to their complexity is the fact that they require two pivotal axes for successful operation. Beyond such an arrangement resulting in a relatively more complicated construction, it also leads to such hand tools being relatively larger than could otherwise be desirable. Although other known rivet pulling mechanisms are known which employ a single pivotal axis between the two levers and a second pivotal axis for a clamping element and one of the two levers, such as the type being generally described in U.S. Pat. No. 4,027,556, and, preferably, used in application to plastic rivets are limited insofar as many commercially available units would be unsuitable for the typical industrial metal rivet. Moreover, such type suffers from the drawback in that it is constructed such that during a setting operation relatively greater force need be applied by the operator to set the rivet.

Apart from the preceding drawbacks, another disadvantage generally associated with the above category of rivet setting tools is that they may be unsafe to an operator should upon rupturing of the mandrel the latter fly away from the tool and strike the operator.

There are other known categories of hand-operated tools having movable tong arms, such as pliers, electrode pulling tools, brake cable release tools, and the like, which serve to pull upwardly on a wide variety of workpieces in response to a closing element of the arms thereof. Such tools are not, however, specifically designed for, much less capable of setting blind rivet fasteners in work material. In addition, such known hand-operated tools designed for pulling upwardly on a workpiece as a result the lever arms thereof being forced together are rather complicated in construction and otherwise cumbersome in operation.

SUMMARY OF THE INVENTION

The present invention overcomes the several noted deficiencies and drawbacks associated with conventional prior art tool pulling devices, and specifically, blind rivet setting tools by significantly simplifying their relatively expensive and complicated constructions. Moreover, the present invention provides a relatively safer rivet setting tool.

Broadly in accordance with the spirit and scope of the present invention, there is provided an apparatus for gripping and pulling on an elongated mandrel which comprises first means having a supporting surface and at least one opening therethrough for receiving the mandrel. Such apparatus embodies second means pivotally connected to the first means for pivotal movement about a pivotal axis between a first position and a second position. The second means is formed with a mandrel receiving portion which cooperates with the rivet mandrel and is conjointly movable therewith. Jaw means are operatively connected to the second means for movement therewith and for movement about said pivotal axis relative thereto towards and away from the mandrel receiving portion. This apparatus contemplates biasing means for biasing the jaw means in the one direction such that the jaw means contacts the supporting surface whenever the second means is in at least the first position whereby a mandrel is insertable through the opening between the receiving portion and the jaw means. The contemplated biasing means also initially biases the jaw means into contact with the supporting surface while the second means moves towards the second position such that the receiving portion moves towards the jaw means to cause the mandrel to become tightly gripped between it and the jaw means, whereupon continued movement of the second means to the second position moves the jaw means away from contact with the supporting surface and into tighter gripping engagement with the mandrel to forcefully pull generally upwardly on the mandrel.

BRIEF DESCRIPTION OF THE DRAWINGS

The above and other objects, features, and advantages of the present invention will become apparent upon reading a detailed description of an apparatus embodying the spirit and principles of the present invention when viewed in conjunction with the accompanying drawings wherein like reference numerals indicate like structure throughout the several views.

DETAILED DESCRIPTION

Figures 1, 2, 2A, 3, 4:
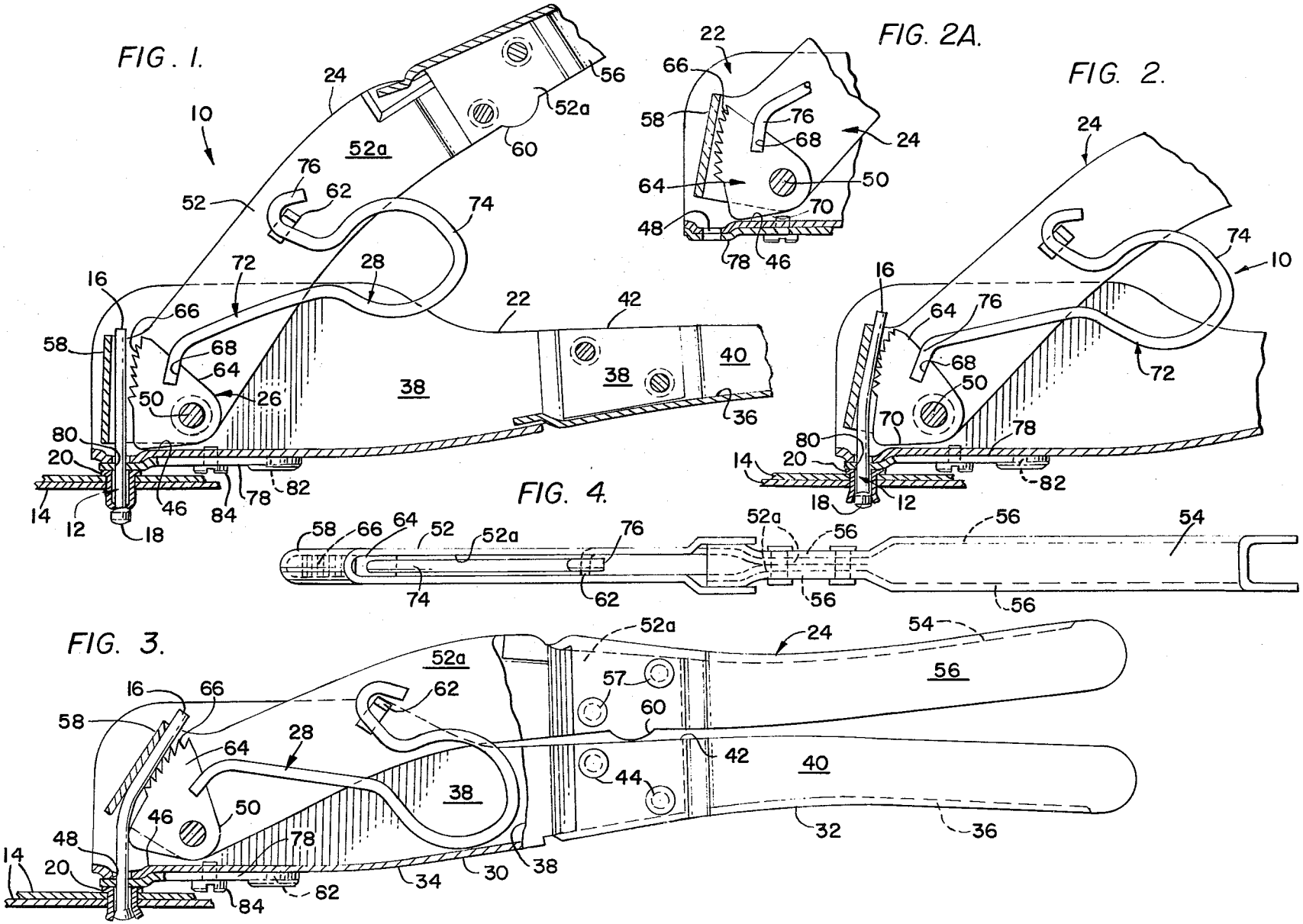
FIG. 1 is fragmentary cross-sectional view of a rivet setting tool embodying the principles of the present invention shown in one particular position wherein a blind rivet mandrel has been inserted thereinto for a subsequent rivet setting operation.
FIG. 2 is a fragmentary cross-sectional view showing the components of the novel and improved rivet setting tool in an intermediate position of operation.
FIG. 2A is a fragmentary view depicting components of the pulling tool in an intermediate or rest condition.
FIG. 3 is a partial cross-sectional view similar to FIG. 1, but showing the blind rivet setting tool in another position, wherein the rivet mandrel is set in suitable material.
FIG. 4 is a generally plan view of one of the handles forming a component of the present rivet setting tool of the instant invention.

Referring to FIGS. 1 to 3 of the drawing, there is best depicted a novel and improved rivet setting tool apparatus embodying the principles of the present invention and designated generally by reference numeral 10. Such tool 10 is hereinafter described as being useful for purposes of setting standard blind rivets 12 in sheets 14 of material or components to be joined so as to have the latter fastened by the former. Generally, these rivets 12 include an elongated mandrel shank 16 having an enlarged head portion 18 and a deformable eyelet portion 20. It is emphasized, however, although the succeeding description is directed to a pulling tool 10 which simply and efficiently sets blind rivets 12, it is to be understood, of course, that the tool is versatile and may be used in other situations wherein a rod-like member is to be grabbed and pulled upwardly.

Hereinafter basically described, the rivet setting pulling tool 10 comprises first means or stationary handle 22, second means or pulling handle 24, jaw means 26, and biasing means 28.

In connection with the first means or stationary handle 22, it is manually grippable and may include two generally U-shaped channel components 30 and 32, respectively. The channel components 30 and 32 have bridging bottom walls 34 and 36, respectively, with opposed sidewalls 38 and 40, respectively, integrally formed therewith. Sidewalls 38 of component 30 converge inwardly, between, and in abutting contact with the opposed and spaced apart sidewalls 40 of component 32 to form a generally flat stop surface 42 which serves to limit movement of the pulling handle 24 in a manner afterwards made evident. The interengaging sidewalls 38 and 40 are suitably fastened together by fasteners 44 or the like. The bridging wall 34 in the first component 30 defines a supporting surface 46 having a mandrel opening 48 therethrough and adjacent its forward end. In the illustrated embodiment, such opening 48 is appropriately dimensioned and configured to receive therethrough rivet mandrels 16 of varying sizes. A pivot pin 50 can be attached, in any known fashion, to sidewalls 38 and extend therethrough. Such pivot pin 50 has its axis relatively close to mandrel opening 48 for enhancing mechanical advantage.

Regarding the second means or pulling handle 24, it is movable between a first or rivet receiving position, such as shown in FIG. 1, to a second rivet setting position depicted in FIG. 3. As perhaps best viewed in FIG. 2A, taken in conjunction with FIG. 4, both the stationary and pulling handles 22 and 24 are shown positioned in a neutral or intermediate rest position without a blind rivet situated between the jaw means 26 and pulling handle 24. As will be later described, by virtue of the biasing means 28, both handles 22 and 24 are pulled relatively together, thus bringing the second means 24 or pulling handle into contact with jaw means 26 as depicted in FIG. 4.

The pulling handle 24 may comprise a forward looped body portion 52 with spaced apart walls 52*a* having the free ends joined together with a second U-shaped channel component 54 such as depicted in FIGS. 1, 3 and 4. As illustrated, the free ends of walls 52*a* are positioned between opposed sidewalls 56 of the second U-shaped component 54. The two components 52 and 54 are fixedly connected together by appropriate fastening members 57. A rivet mandrel receiving portion 58 is formed at the forward portion of the loop 52, and whenever the pulling handle 24 is in the first position it is sufficiently spaced from jaw means 26 to enable insertion of the rivet mandrel 16 therebetween. Also, as best depicted in FIGS. 1 and 3, the end of walls 52*a* and sidewalls 56 have rounded stop protrusions 60 arranged so as to abut surface 42 to thereby arrest movement of the handles 22 and 24 in the second position. The invention contemplates that other types of stopping arrangements may be used to arrest movement of the handles together.

Looped portion 52 may include a plurality of aligned openings (not shown) which accommodate pivot pin 50. A support ear 62 may be formed from one of the spaced apart sidewalls 52*a* and arranged to extend between such sidewalls to provide a support for the biasing means 28 in a fashion to be afterward described. As best shown in FIG. 4, the arcuate mandrel receiving portion 58 contacts the top of jaw means 26, such as whenever in the neutral or rest position. This contact occurs by virtue of the biasing means 28 pulling the two handles 22 and 24 relatively towards each other and the biasing means 28 urging the mandrel receiving portion 58 towards the jaw means 26. By reason of such fact, the jaw means 26 is movable with the pulling handle 24. Additionally, the present invention contemplates that the arcuate mandrel receiving portions 58 may have other configurations besides being arcuate. Additionally, the mandrel receiving portion 58 serves do not only facilitate movement of the rivet mandrel 16 into engagement with the jaw means 26 whenever the pulling handle moves towards the second mandrel setting position, but as will be later explained, also withstands the compressive forces applied thereon by jaw means 26 during the setting operation. As is apparent, the material forming both handles 22 and 24 and, in particular, mandrel receiving portion 58, should possess sufficient strength for the purposes envisioned. Although the stationary and pulling handles 22 and 24, respectively, are described as being fabricated from the above noted components arranged in the above fashion, it should be pointed out that each of the handles can be made of a single integrally formed U-shaped member. The particular construction of the handles do not form an aspect of this invention since various types are envisioned.

As concerns the jaw means 26 of the embodiment being illustrated, it may have any configuration and is shown being comprised of a generally flat triangular-shaped jaw plate member 64. Desirably, upwardly directed wedge-shaped teeth 66 are formed along a portion of one edge of jaw member 64 which is pivotally mounted on the pivot pin 50 between the sidewalls 52*a* of loop portion 52 for relative rotation with respect thereto, such as whenever there is no contact between mandrel receiving portion 58 and jaw member 64. With the teeth 66 formed so that they face upwardly, they have a tendency to deeply penetrate and wedgingly grip the mandrel 16 during rivet setting, such as when pulling handle 24 moves from its first rivet receiving position to the second rivet setting position. Accordingly, the teeth 66 have a tendency to prevent mandrel withdrawal during such setting operation. A notch 68 is formed in one end of the jaw member 64 for purposes presently described. Another end 70 of jaw member cooperates with the supporting surface 46 adjacent mandrel opening 48 and pivot pin 50 to stop movement of the jaw member whenever the tool 10 is in the rivet receiving position. As can be understood by reference to FIGS. 1, 2A and 4, the jaw member 64, under action of biasing means 28, contacts the loop portion 52 which is movable to the position shown in FIG. 1 from an intermediate location depicted in FIG. 2A whenever the pulling handle 24 moves in the same direction. As noted, it is within the spirit and scope of the invention not to have any direct contact between the jaw member 64 and loop portion 52. In such event, the biasing means 28 would always force the jaw 64 into contact with supporting surface 46 whenever there is no mandrel between the receiving portion 58 and jaw member 64.

Now referring to the biasing means 28, it may be comprised of a torsion spring 72 having a relatively enlarged loop 74 with bent tang extremities 76. One tang 76 is frictionally held within notch 68, while the other tang is bent about the support ear 62 in suitable fashion. Given the inherent resiliency and biasing spring tension forces generated by such a torsion spring 72, the jaw member 64 is normally urged in a counterclockwise direction towards mandrel receiving portion 58.

As earlier described, the torsion spring 72 normally acts to bias the handles 22 and 24 together into a neutral or intermediate position. Also, the spring tension force provided by spring 72 facilitates penetration of teeth 66 into mandrel 16 whenever pulling handle 24 is moved to the rivet setting position. The biasing force is selected such that it will tightly compress the teeth 66 into the mandrel 16 to prevent the teeth from slipping during setting as well as provide a sufficient force to prevent the spent mandrel from flying out the top whenever the mandrel ruptures. In addition, the torsion spring 72 also serves to force jaw member 64 into contact with the supporting surface 48 to thereby arrest rotation of the latter. Although the jaw member 64 is biased into contact, the pulling handle 24 is free to move relative thereto in either direction. Reference is made to FIGS. 1, 2A and 3 to illustrate the relative positions. In FIG. 1, for example, the mandrel receiving portion 58 is spaced away from the jaw member 64 by a distance which is sufficient to have the rivet mandrel 16 insertable between it and the jaw member 64. Although the present embodiment describes a torsion spring, it is understandable that a wide variety of springs, such as compression and leaf springs, are contemplated so long as such springs provide a sufficient biasing force to ensure rotation of the jaw member 64 into engagement with the mandrel during a setting movement and prevents ruptured mandrels from flying out.

As shown in the drawings, the tool is arranged such that the mandrel is bent during setting as the jaw member 64 and pulling handle 22 with mandrel receiving portion 58 pivot about pivot pin 50 (see FIGS. 1 to 3). Accordingly, there is less of a tendency for the mandrel to fly outwardly and strike the face of an operator. Moreover, as noted, the spring force also tends to prevent the mandrel from flying outwardly after rupturing.

The rivet setting tool 10 of the invention includes a known type of adjusting turret means 78. The turret 78 is defined by an elongated plate and has different dimensioned openings 80 and 82 in opposed ends thereof to advantageously accommodate rivet mandrels 16 of different sizes. A screw 84 connects the turret 78 to the bottom wall 34. Such screw 84 is loosened and the turret 78 is turnable thereabout to enable a desired opening 80 or 82 to be situated in registry with the mandrel opening 48.

After having described the above constructional arrangement of pulling tool 10, the operation thereof is believed to be self-evident. To supplement such description, however, the following will briefly touch upon a typical blind rivet setting operation. With initial reference to FIG. 2A, the components forming the rivet setting tool 10 are depicted in a neutral or intermediate position wherein the tool does not cooperate with a blind rivet 12. This position of structure results by reason of the torsion spring 72 tending to bias the handle arms 22 and 24 together. In the neutral position, the mandrel receiving portion 58 is brought close to teeth 66 of jaw member 64. As shown in FIG. 4, the spring generally causes contact between the receiving portion 58 and top of the jaw member 64. Consequently, the jaw member 64 is movable with loop portion 52 of handle 24.

To set a particular rivet, the pulling handle 24 is moved from the intermediate position of FIG. 2A to the first position shown in FIG. 1. During such an action, the pulling handle 24 moves relatively apart from stationary handle 22 which receives mandrel 16 and overcomes the bias of the torsion spring 72. Also during this movement, the jaw member 64 initially abuts the supporting surface 46 while pulling handle 24 and mandrel receiving portion 58 continue to pivot until the jaw member 64 is sufficiently spaced from the receiving portion, much as in the fashion depicted in FIG. 1. As a consequence thereof, a mandrel 16 is insertable between the receiving portion 58 and teeth 66 of jaw member 64.

Once in this position, the operator merely forces both the pulling handle 24 relatively towards the stationary handle 22. Initially during this process, the torsion spring 72 continues to yieldable force the jaw 64 onto supporting surface 46 while the mandrel receiving portion 58 conjointly moves with the pulling handle 24 and serves to force the mandrel 16 into a tight gripping contact with jaw teeth 66. Accordingly, the mandrel 16 is compressed between the receiving portion 58 and jaw plate 64 so that the latter is movable with pulling handle 24. In this regard, see FIG. 2. As a consequence of continued movement of pulling handle 24 to the position shown in FIG. 3, the jaw member 64 is lifted from supporting surface 46. The wedging action provided by the jaw member 64 and receiving portion 58 contacting the mandrel causes a tighter gripping of the teeth on the mandrel as the pulling handle moves from the position shown in FIG. 1 towards the second rivet setting position. Also, the torsion spring 72 owing to its spring tension forces the jaw teeth 66 into engagement with the mandrel 16. Also, in practice, the teeth 66 which have the tendency to penetrate mandrel 16 enhances a wedge-like grip in response to squeezing of handles 22 and 24. As indicated, the receiving portion 58 is sufficiently strong to withstand the compression forces exerted thereon during a setting operation without failure. Also, the spring 72 which serves to prevent the mandrel 16 from slipping during rivet setting, has a tendency to prevent the mandrel from flying away when the mandrel ruptures and possibly striking an operator. As earlier noted, common pivot for the pulling handle 24, mandrel receiving portion 58 and jaw member 64 causes the mandrel to bend during squeezing of the handles. Consequently, the mandrel 16 is pulled generally upwardly and bent until it is ruptured by the noted pulling forces as the pulling handle 24 moves to the position shown in FIG. 3. As noted, the common pivot for both handles, mandrel receiving portion and the jaw member provides for the bending action. Such bending enhances safety by reducing the tendency of the ruptured mandrel striking the face of an operator.

Owing to the mechanical advantage provided by the tool, the wedging action of the mandrel receiving portion 58 and the jaw member 64, along with the spring tension forces exerted by spring 72, the mandrel 16 is more easily pulled and bent by the jaw member 64 and receiving portion 58. The squeezing action is stopped when the curved protrusions 60 on the pulling handle 24 contact the stop surface 42 to limit movement of both handles. It is noted that this upward pulling force is sufficient to also cause the rivet head 18 to deform the eyelet 20 in conventional fashion.

In order to release the bent and snapped mandrel 16, the pulling handle 24 is moved in the opposite direction, away from the stationary handle 22 and relative to jaw member 64 until sufficient clearance exists between such jaw member and rivet receiving portion 58 whereby the mandrel 16 can be expelled. As is evident, the tool 10 is set for another rivet setting operation. After removal of the rivet mandrel 16, the bias provided by torsion spring 72 brings the handles 22 and 24, jaw member 64 and receiving portion 58 back to an intermediate or neutral position.

It will be appreciated that the rivet setting tool 10 of this particular invention, besides being unique and unobvious is extremely simple in construction and efficient and safe in operation. By such construction, the handles, jaw member and rivet receiving portion results in a rivet setting tool able to be produced in a manner which is less complicated and expensive in comparison to conventional rivet setting tools. Apart from the preceding significant advantages, it is apparent that the tool envisioned by the instant invention can in a safe, reliable and simple fashion effectively and efficiently grasp and pull on other rod-like elements. Thus, the tool of the instant invention is versatile in that it contemplates other applications besides blind rivets. Accordingly, the present invention marks a significant advance and valuable contribution in the tool pulling art and, in particular, the blind rivet setting field.

While the invention has been described in connection with the preferred embodiment, it is not intended to limit the invention to the particular form set forth above, but, on the contrary, it is intended to cover such alternatives, modifications, and equivalents as may be included within the spirit and scope of the invention as defined by the appended claims.

What is claimed is:

1. Apparatus for gripping and pulling on an elongated mandrel comprising first means having a supporting surface and at least one opening therethrough for receiving the mandrel; second means pivotally connect to the first means for pivotal movement about a pivotal axis between a first position and a second position, said second means has a mandrel receiving portion which cooperates with the mandrel and is conjointly movable therewith; jaw means operatively connected to the second means for movement therewith and for movement relative thereto about said pivotal axis towards and away from the mandrel receiving portion; and biasing means for biasing said jaw means in one direction such that said jaw means contacts said supporting surface whenever the second means is in at least the first position and a mandrel is insertable through the opening and between said receiving portion and said jaw means, said biasing means initially biases the jaw means into contact with the supporting surface while the second means moves to the second position such that the receiving portion moves towards said jaw means to cause the mandrel to become tightly gripped between it and the jaw means whereupon the continued movement of said second means to the second position moves said jaw means away from contact with said supporting surface and into tighter gripping engagement with the mandrel to forcefully pull generally upwardly on the mandrel.

2. The apparatus as set forth in claim 1 wherein said second means is defined by a generally elongated second handle having at least an integrally looped section pivotally mounted to said first means and defining said mandrel receiving portion, and said jaw member mounted between said looped section for relative movement therewith whenever said jaw member does not contact said looped section and for movement with said looped section whenever there is contact.

3. The apparatus as set forth in claim 1 wherein said jaw means includes jaw teeth on one side thereof.

4. The apparatus as set forth in claim 3 wherein said biasing means is comprised of a spring having one loop defined thereby and providing a biasing force on said jaw means which serves to prevent a ruptured mandrel from flying out.

5. The apparatus as set forth in claim 4 wherein said jaw means is defined by a generally flat polygonal-shaped member with said teeth on said one side and said teeth being shaped so as to resist withdrawal of the mandrel during a setting operation, a second side being formed to contact said supporting surface, and a third side being forced with a notch to receive one end of said torsion spring.

6. The apparatus as set forth in claim 5 wherein said first means is defined by a generally elongated first handle portion having a channel portion adjacent the forward end to permit said second means to pivot between said first and second position.

7. Apparatus for gripping and pulling on an elongated mandrel comprising first means having a supporting surface and at least one opening therethrough for receiving the mandrel; second means pivotally connected to the first means for pivotal movement about a pivotal axis between a first position and a second position, said second means has a mandrel receiving portion which cooperates with the mandrel and is conjointly movable therewith; jaw means operatively connected to the second means for movement therewith and for movement relative thereto about said pivotal axis towards and away from the mandrel receiving portion defined by a generally flat polygonal-shaped member with teeth on one side thereof and being shaped so as to resist withdrawal of the mandrel during a setting operation, a second side being formed to contact said supporting surface, and a third side being formed with a notch, and biasing means for biasing said jaw means in one direction such that said jaw means contacts said supporting surface whenever the second means is in at least the first position and a mandrel is insertable through the opening and between said receiving portion and said jaw means, said biasing means initially biases the jaw means into contact with the supporting surface while the second means moves towards the second position such that the receiving portion moves towards said jaw means to cause the mandrel to become tightly gripped between it and the jaw means whereupon the continued movement of said second means to the second position moves said jaw means away from contact with said supporting surface and into tighter gripping engagement with the mandrel to forcefully pull generally upwardly on the mandrel, biasing means is comprised of a spring having one loop defined thereby, said first means is defined by a generally elongated first handle portion having a channel portion adjacent the forward end to permit said second means to pivot between said first and second position, said second means is defined by a generally elongated second handle having at least a looped section pivotally mounted to said first handle and defining said mandrel receiving portion, and said jaw member mounted between said looped section for relative movement therewith whenever said jaw member does not contact said looped section and for movement with said looped section whenever there is contact.

8. Apparatus for gripping and pulling on an elongated mandrel comprising first handle having a supporting surface and at least one opening therethrough for receiving the mandrel; second means pivotally connect to the first means for pivotal movement about a pivotal axis between a first position and a second position, said second means has a mandrel receiving portion which cooperates with the mandrel and is conjointly movable therewith; jaw means operatively connected to the second means for movement therewith and for movement relative thereto about said pivotal axis towards and away from the mandrel receiving portion; and biasing means for biasing said jaw means in one direction such that said jaw means contacts said supporting surface whenever the second means is in at least the first position and a mandrel is insertable through the opening and between said receiving portion and said jaw means, said biasing means initially biases the jaw means into contact with the supporting surface while the second means moves to the second position such that the receiving portion pivotally moves towards said jaw means to cause the mandrel to become tightly gripped between it and the jaw means whereupon the continued movement of said second means towards the second position moves said jaw means away from contact with said supporting surface and into tighter gripping engagement with the mandrel to forcefully pull generally upwardly on the mandrel thereby bending the mandrel as said mandrel receiving portion, said second means and said jaw means conjointly pivot about said pivotal axis whereby less of a tendency exists for a ruptured mandrel to fly in the face of an operator.

9. The apparatus as set forth in claim 8 wherein said biasing means provides a biasing force on said jaw means which serves to prevent a ruptured mandrel from flying out.

10. The apparatus as set forth in claim 9 wherein said second means is defined by a generally elongated second handle having at least on integrally looped section pivotally mounted to said first handle and defining said mandrel receiving portion, and said jaw member mounted between said looped section for relative movement therewith whenever said jaw member does not contact said looped section and for movement with said looped section whenever there is contact.

* * * * *

UNITED STATES PATENT AND TRADEMARK OFFICE

CERTIFICATE OF CORRECTION

PATENT NO. : 4,088,004

DATED : May 9, 1978

INVENTOR(S) : Anthony E. Di Maio and Joseph G. Todisco

It is certified that error appears in the above-identified patent and that said Letters Patent are hereby corrected as shown below:

Column 4, line 66 "serves do not" should be changed to --serves to not--;

Column 10, line 42, "least on" should be changed to --least an--.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*